United States Patent [19]

Brook

[11] 4,122,953

[45] Oct. 31, 1978

[54] METHOD AND APPARATUS FOR GRADING ARTICLES

[75] Inventor: Richard M. Brook, Kirkheaton, Huddersfield, England

[73] Assignee: Auto Systems Limited, Yorkshire, England

[21] Appl. No.: 828,687

[22] Filed: Aug. 29, 1977

[30] Foreign Application Priority Data

Sep. 7, 1976 [GB] United Kingdom ..... 36952/76

[51] Int. Cl.[2] ..... B07C 7/00

[52] U.S. Cl. ..... 209/551; 209/705

[58] Field of Search ..... 209/125, 73, 74 M, 121; 214/11 R, 11 A, 11 C; 340/259

[56] References Cited

U.S. PATENT DOCUMENTS 4,021,336 5/1977 Brook ..... 209/74 M

*Primary Examiner*—Allen N. Knowles

*Attorney, Agent, or Firm*—John C. Smith, Jr.

[57] ABSTRACT

A method of associating one of at least two grades with each of a plurality of articles which are to be fed in succession along a path, comprises feeding one grade of article into the path at a first feed station, for movement along the path, feeding a second grade of article into the path at a second feed station arranged upstream of the first feed station, so that only grades of article other than the one grade travel along the path from the second feed station to the first feed station but after the first feed station all grades of article travel along the path, arranging a first sensor between the first feed station and the second feed station, the first sensor being arranged to emit a signal each time an article passes the first sensor and having means to associate each signal with the article which generates the signal, and utilizing the signals to associate grades with the articles.

9 Claims, 5 Drawing Figures

METHOD AND APPARATUS FOR GRADING ARTICLES

BACKGROUND OF THE INVENTION

The invention relates to the grading of articles, for example to the grading of poultry carcasses moving along a path through a poultry processing plant.

DESCRIPTION OF THE PRIOR ART

In the processing of articles, it is frequently necessary to feed the articles through a processing plant and sort or otherwise process the articles according to the grade or quality of the article. Apparatus is known in which an operator can assign one of a plurality of grades to each of a succession of articles moving along a path, the apparatus then storing the information as to grade and bringing the information out of store when each article reaches a point in the path where the information as to grade is to be used to control the processing of the article. For instance it may be desired to remove articles of a particular grade at an article removal station which is downstream of the point where the operator assigns a grade to the article. Such apparatus is for example described in U.S. Pat. No. 4,021,336.

However in known apparatus the articles must first be loaded on to a conveyor in succession by an operator, and the articles then pass through a grading station where an operator feeds into the control circuitry of the apparatus information about the grade of each article, for example using a manual console as described in U.S. Pat. No. 4,021,336. Thus two separate operations have to be carried out: a loading operation followed by a grading operation. Furthermore, difficulties can arise in assigning grades once the articles are moving along the conveyor and quick reflexes are required on the part of the grading operator. The operator must examine each article while it is moving and operate the grading console while the article is at a particular point on the conveyor, so that the control apparatus associates the correct grade with the article, and not with a subsequent article.

The operators problems are eased somewhat with the use of the special grading console described in U.S. Pat. No. 4,021,336 but the operator must still make fairly rapid decisions while the articles are moving along the conveyor and furthermore the grading console and associated apparatus are relatively complex.

SUMMARY OF THE INVENTION

I have now appreciated that the grading can be simplified, and one operation can be eliminated entirely, by loading different grades of article on to a conveyor at different feed stations, so that articles of one grade follow a longer path than articles of another grade, this fact then being used to generate automatically information about grade for transmission to control circuitry, without any further action being required by an operator. The different feed stations can be adjacent to one another, so the use of different feed stations need not require the use of more operators than are required with known apparatus, and indeed it may be possible to use fewer operators, since grading is in effect carried out simultaneously with loading.

Accordingly the invention provides a method of associating one of at least two grades with each of a plurality of articles which are to be fed in succession along a path, comprising feeding one grade of article into the path at a first feed station, for movement along the path, feeding a second grade of article into the path at a second feed station arranged upstream of the first feed station, so that only grades of article other than the one grade travel along the path from the second feed station to the first feed station but after the first feed station all grades of article travel along the path, arranging a first sensor between the first feed station and the second feed station, the first sensor being arranged to emit a signal each time an article passes the first sensor and having means to associate each signal with the article which generated the signal, and utilising the signals to associate grades with the articles.

Where it is desired to associate one of three grades with each of a plurality of articles, the third grade of article may be fed into the path at a third feed station arranged upstream of the second feed station, a second sensor being arranged between the second feed station and the third feed station, so that each article of the third grade generates one signal when it passes the second sensor and another signal when it passes the first sensor, these two signals being utilised in the association of the third grade with each article of the third grade.

The invention also provides a method of associating one of a plurality of grades with each of a plurality of articles which are to be fed in succession along a feed path, comprising: feeding each grade of article into the path at a different feed station, the feed stations being spaced apart along the path so that it is only after the feed station furthest downstream that articles of all grades can travel along the path; arranging a sensing device between each pair of adjacent feed stations to emit a signal each time an article passes the sensing device, the arrangement thus causing each grade of article to initiate a different number of signals; and utilising these different numbers of signals to control the subsequent treatment of each article in dependence upon the grade of the article.

The invention further provides apparatus for use in associating one of a plurality of grades with each of a plurality of articles which are to be fed in succession along a feed path, comprising a plurality of feed stations spaced apart along the feed path, one feed station for each grade, so that each grade of article can be fed into the feed path at a different station, a sensing device arranged between each pair of adjacent feed stations to emit a signal each time an article passes the sensing device, the arrangement thus being such that each grade of article initiates a different number of signals, and a control device arranged to receive and store the signals for use in the subsequent treatment of each article in dependence upon the grade of the article.

DESCRIPTION OF EMBODIMENTS OF THE INVENTION

Figure 1:
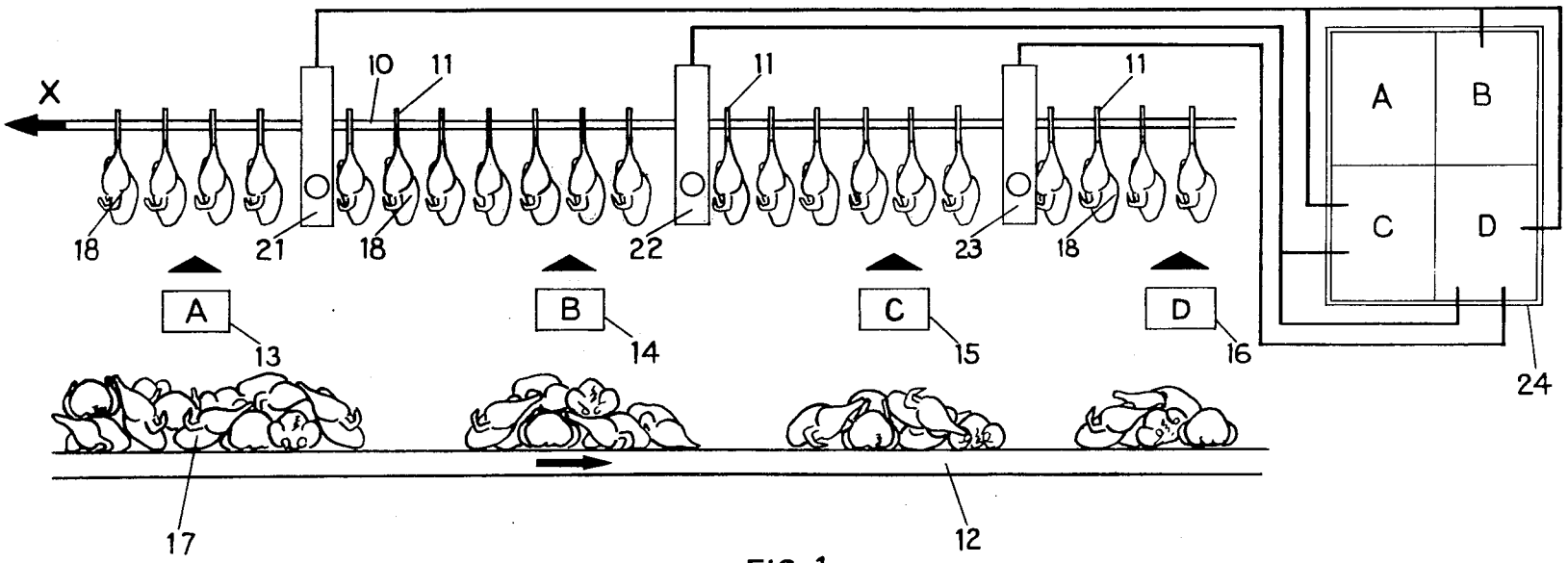
FIG. 1 is a schematic illustration of a first embodiment of grading apparatus according to the invention.

The embodiment of grading apparatus shown in FIG. 1 is intended for use with an overhead poultry carcass carrying conveyor system, in which poultry carcasses are conveyed in succession along a poultry processing line, and are processed according to their grade. The endless overhead conveyor is illustrated diagrammatically at 10 and each item 11 illustrates diagrammatically a shackle to which a poultry carcass can be attached by an operative working beside the conveyor. The direction of movement is indicated by the arrow X.

The grading apparatus is arranged to associate one of four grades with each of the poultry carcasses, for example top quality birds (Grade A), secondary quality birds (Grade B), slightly marked birds (Grade C) and damaged birds (Grade D).

The carcasses 17 are fed from a supply by a belt conveyor 12 past four feed stations 13, 14, 15 and 16. The belt conveyor runs in the opposite direction to the continuous overhead conveyor 10. At station 13 an operative picks up Grade A birds and hangs them on the shackles 11. Birds which have been hung on the conveyor shackles are illustrated diagrammatically at 18.

Since the Grade A birds are removed at feed station 13, Grade B, C and D birds are carried on upstream of the overhead conveyor and at station 14 Grade B birds are removed and hung on the shackles 11. Similarly Grade C birds are hung on at station 15 and Grade D birds are hung on at station 16. If necessary, means such as a plough blade or buffer may be provided to arrest the carcasses on the belt conveyor at each station, to allow the operative time to select birds of the relevant grade for hanging on to the shackles. Any birds which are not to be removed at that station are passed over the plough blade or buffer by the operative to be carried on to the next station upstream by the belt conveyor.

It will be appreciated that at station 15 some shackles may already be occupied by Grade D birds passing downstream from station 16. Similarly at stations 13 and 14 some of the shackles coming downstream may be occupied, and the succession of birds which travels downstream from station 13 may thus contain birds of all four grades, intermingled in any order. It is important for the subsequent processing of the carcasses that the grading apparatus can generate information as to the grade of each carcass and store this information for subsequent use. The grading apparatus accordingly comprises three sensing devices 21, 22 and 23. Sensing device 21 is positioned between stations 13 and 14, sensing device 22 is positioned between stations 14 and 13, and sensing device 23 is positioned between stations 15 and 16. Each sensing device is arranged to emit a signal each time a carcass passes the sensing device. Each sensing device may have the form disclosed in my copending U.S. patent application Ser. No. 791,139 filed Apr. 25, 1977.

The three sensing devices are connected to a control unit 24. It will be seen that because of the positioning of the feed stations and the sensing devices, a Grade D carcass will generate three signals in succession, a Grade C carcass will generate two signals in succession, a Grade B carcass will generate one signal, and a Grade A carcass will generate no signals. Thus each grade of carcass affects the control unit in a different way, and so the different grades can be identified and recorded by the control unit.

Figure 2:
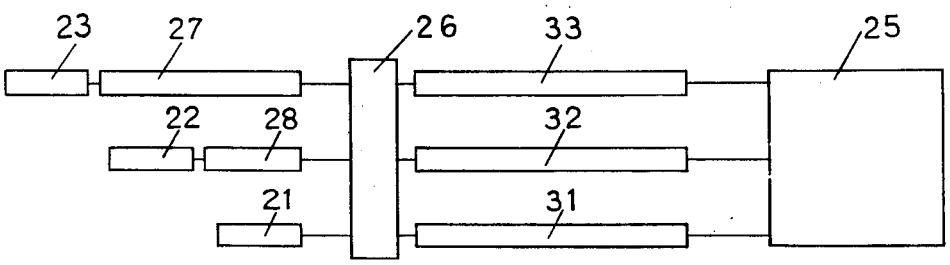
FIG. 2 is a schematic illustration of control apparatus forming part of the grading apparatus shown in FIG. 1.

In general the information relating to grade is required for use at a point downstream of the feed stations 13 to 16. The apparatus must therefore be capable of storing the information provided by each carcass, and bring that information out of store when the carcass associated with the information reaches the particular point downstream. FIG. 2 illustrates a suitable control unit which can be used for this purpose. The unit has control circuitry 25 associated with the particular point downstream and when any particular carcass reaches that point, the circuitry 25 requires a signal indicating the grade of carcass which is at that point. It may require that information to actuate apparatus at that point, for example if it is required to remove birds of a particular grade from the conveyor, or it may require the information to programme further control apparatus. For example it may require the information relating to grade to associate it with further information relating to the weight of the carcass, for example for use with apparatus as described in U.S. Pat. No. 4,021,336, the grading apparatus according to the present invention taking the place of the grading apparatus disclosed in that application, and feeds its grading information into the control and inhibition unit described in U.S. Pat. No. 4,021,336.

The three sensing devices 21, 22 and 23 are connected to a gating unit 26. The sensing device which is furthest upstream, i.e. sensing device 23, is connected to the gating device via a shift register 27, the number of sections in the shift register being related to the number of conveyor shackles lying between sensing device 23, and sensing device 21. Sensing device 22 is connected to the gating device via a shift register 28 having a smaller number of sections, equal to the number of conveyor shackles lying between sensing device 22 and sensing device 21. The sensing device 21 is connected directly to the gating device 26. The effect of the shift registers 27 and 28 is that signals generated by carcasses passing the sensing device 22 and 23 are not fed directly to the gating device 26 but are stored in the shift registers for a certain period of time. For example a grade C carcass initiates a first signal when it passes sensing device 22. This signal passes to the shift register 28 and as the carcass progresses downstream, the signal is stepped through the shift register and emerges from the shift register into the gating device 26 at the same time as the same carcass initiates a signal by passing sensing device 21. Similarly the three signals which are generated by a Grade D carcass are all fed to the gating device 26 at the same moment in time.

The gating device 26 has its output side connected to three further shift registers 31, 32 and 33. These three shift registers have the same number of sections, the number being related to the number of conveyor shackles lying between the sensing device 21, and the point downstream associated with the control circuitry 25.

Each time a Grade B carcass reaches the sensing device 21, the gating device 26 receives a single signal, which causes the gating device to feed a single signal into the first section of shift register 31, which shift register is associated with Grade B. As the Grade B carcass progresses down the conveyor line, the signal in the Grade B shift register 31 is stepped through the shift register, and it is fed into the control circuitry 25 when the Grade B carcass reaches the point downstream which is associated with the control circuitry.

Whenever a Grade C carcass passes the sensing device 21, two signals are fed into the gating device 26, one direct from the sensing device 21, and one from the shift register 28. Whenever it receives two signals simultaneously, the gating device 26 is arranged to feed a single signal into shift register 32, which is associated with Grade C carcasses. Thus whenever the control circuitry 25 receives a signal from the shift register 32, it is aware that a Grade C carcass has reached the relevant point downstream of the feed stations.

Whenever a Grade D carcass reaches the sensing device 21, the gating device 26 receives three signals simultaneously, and in response to the receipt of three signals, it feeds a single signal into the shift register 33, which is associated with Grade D carcasses.

Grade A carcasses do not generate any sensing signals, and the control circuitry 25 is arranged so that if it does not receive a signal from any of the three shift registers 31 to 33 when a carcass passes the downstream point associated with the control circuitry, the control circuitry treats that carcass as a Grade A carcass.

Figure 3:
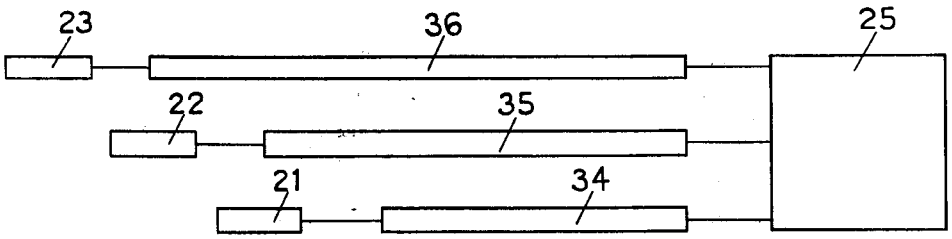
FIG. 3 is a schematic illustration of alternative control apparatus for the grading apparatus shown in FIG. 1.

In an alternative arrangement, the analysis of the signals, for example by a gating device such as that shown at 26, may be incorporated in the control circuitry 25, each of the sensing devices 21, 22, and 23 simply being connected to the control circuitry 25 by shift registers 34, 35 and 36 as shown in FIG. 3. Each shift register has a number of sections which is related to the number of conveyor shackles lying between the associated sensing device and the point on the conveyor associated with the control circuitry 25, so that whatever signals are received by the control circuitry 25 at any moment in time are signals which have been initiated by the carcass which is at the downstream point at that moment in time.

Figure 4:
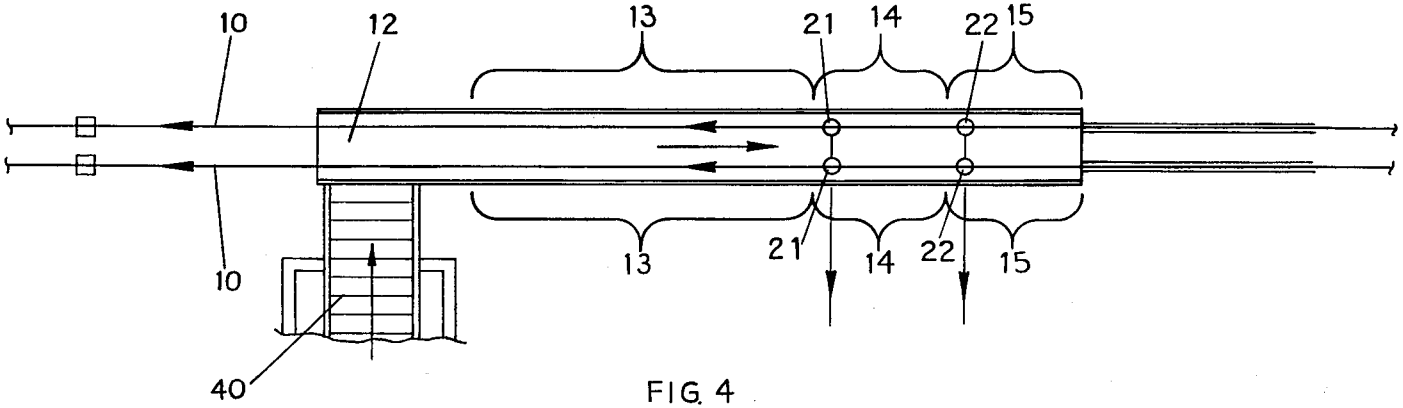
FIG. 4 is a plan view of part of a conveyor system for use with the apparatus shown in FIG. 1.

FIG. 4 shows one arrangement of belt conveyor suitable for use with grading apparatus to the invention. In the arrangement shown in plan view in FIG. 4, there are two overhead conveyors 10 operating side by side, and travelling from right to left as viewed in the Figure, as illustrated by the arrows. There are thus two Grade A feed stations 13, two Grade B feed stations 14, and two Grade C feed stations 15. There are two sensing devices 21 and two sensing devices 22. Sensing devices 23 and the Grade D feed station have not been shown, for the sake of simplicity. It will be appreciated that the principle of the apparatus according to the invention can be extended to any desired number of grades, simply by increasing the number of feed stations and the number of sensing devices.

Figure 5:
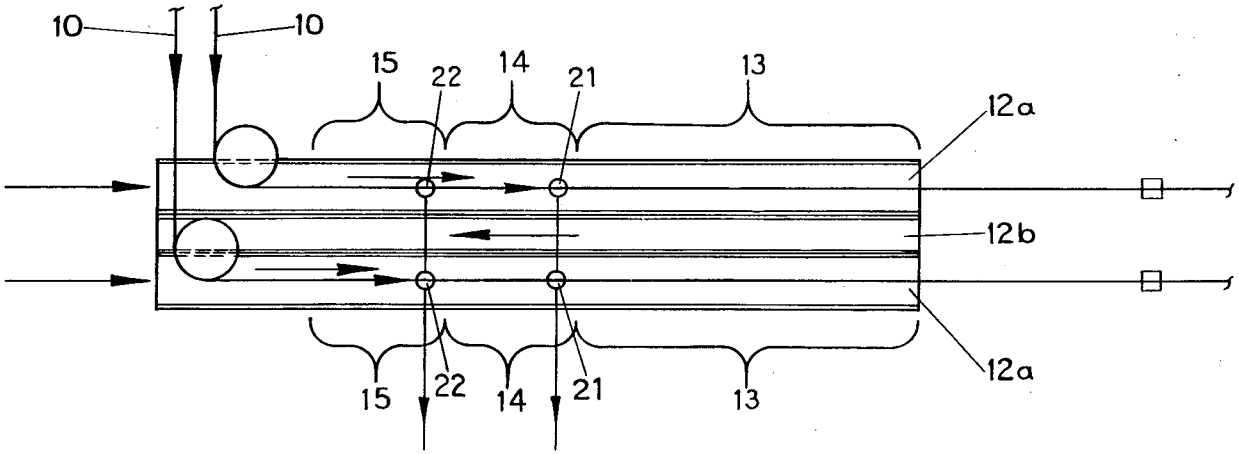
FIG. 5 is a plan view of part of an alternative conveyor system for use with the apparatus shown in FIG. 1.

A conveyor or elevator 40 brings carcasses from a chiller and deposits the carcasses on a central belt conveyor 12 positioned parallel to and below the conveyors 10, and running in the opposite direction. The carcasses are carried along this conveyor and operatives standing at each side of the belt conveyor remove carcasses at the various feed stations and hang the carcasses on the shackles of the overhead conveyors 10. In an alternative arrangement shown in FIG. 5, carcasses are fed into the conveyor system at a point where two continuous conveyors 10 turn a corner. There are three belt conveyors, two conveyors **12*a* running underneath the conveyors 10 respectively, and in the same direction, and a central belt conveyor 12*b* travelling in the reverse direction. As in the arrangement shown in FIG. 4, there are two sets of feed stations and two sets of sensing devices. Operatives load Grade A carcasses on to the shackles at the feed stations 13, and place any lower grade carcasses on the central conveyor 12*b***, to be carried upstream to the other stations.

The invention is not restricted to the features of the foregoing embodiments. For instance for some applications it may be desirable to utilise a further sensing device so that Grade A carcasses also provide a signal. The principle is that each carcass of a particular grade generates a different number of signals to that generated by a carcass having any other grade, and is thus distinguishable.

The invention is not restricted to the processing of poultry carcasses and it will readily be appreciated that the invention has useful applications in any process where articles are conveyed in succession along a path and are subsequently processed according to their grade or quality.

I claim:

1. A method of associating one of at least two grades with each of a plurality of articles which are to be fed in succession along a path, comprising feeding one grade of article into the path at a first feed station, for movement along the path, feeding a second grade of article into the path at a second feed station arranged upstream of the first feed station, so that only grades of articles other than the one grade travel along the path from the second feed station to the first feed station but after the first feed station all grades of article travel along the path, arranging a first sensor between the first feed station and the second feed station, the first sensor being arranged to emit a signal each time an article passes the first sensor and having means to associate each signal with the article which generates the signal, and utilising the signals to associate grades with the articles.

2. A method as claimed in claim 1, for associating one of three grades with a plurality of articles, in which the third grade of article is fed into the path at a third feed station arranged upstream of the second feed station, and a second sensor is arranged between the second feed station and the third feed station, so that each article of the third grade generates one signal when it passes the second sensor and another signal when it passes the first sensor, these two signals being utilised in associating the third grade with each article of the third grade.

3. A method of associating one of a plurality of grades with each of a plurality of articles which are to be fed in succession along a feed path, comprising: feeding each grade of article into the path at a different feed station, the feed station being spaced apart along the path so that it is only after the feed station furthest downstream that articles of all grades can travel along the path; arranging a sensing device between each pair of adjacent feed stations to emit a signal each time an article passes the sensing device, the arrangement thus causing each grade of article to initiate a different number of signals; and utilising these different numbers of signals to control the subsequent treatment of each article in dependence upon the grade of the article.

4. Apparatus for use in associating one of a plurality of grades with each of a plurality of articles which are to be fed in succession along a feed path, comprising a plurality of feed stations spaced apart along the feed path, one feed station for each grade, so that each grade of article can be fed into the feed path at a different station, a sensing device arranged between each pair of adjacent feed stations to emit a signal each time an article passes the sensing device, the arrangement being such that each grade of article initiates a different number of signals, and a control device arranged to receive and store the signals for use in the subsequent treatment of each article in dependence upon the grade of the article.

5. Apparatus as claimed in claim 4, in which the control device has means to associate a grade with each article in dependence upon the number of signals initiated by the article.

6. Apparatus as claimed in claim 5, in which there are at least three feed stations and at least two sensing devices, the control device has means to receive signals from each sensing device and the control device also has means to delay the signals from each sensing device other than the sensing device which is furthest downstream, so that when an article passes more than one sensor and hence initiates more than one signal, the receiving means simultaneously receives all the signals initiated by one article.

7. Apparatus as claimed in claim 6, in which the delay means comprises at least one shift register.

8. Apparatus as claimed in claim 5, in which there is a gating device which receives all the signals initiated by each article in turn and feeds a grading signal to part of the control device in dependence upon the number of signals initiated by the article.

9. Apparatus as claimed in claim 4, comprising an overhead conveyor arranged to travel along the path and pass through the feed stations to receive the articles, and a belt conveyor arranged underneath the overhead conveyor to carry ungraded articles underneath the feed stations so that an operator can lift articles off the belt conveyor and load them on to the overhead conveyor at any one of the feed stations, according to the grade of the article.

* * * * *